US006079900A

United States Patent [19]

Kumagawa et al.

[11] Patent Number: 6,079,900

[45] Date of Patent: Jun. 27, 2000

[54] PAVEMENT COMPOSITE MATERIAL WITH ELASTIC SURFACE LAYER AND PRODUCTION METHOD THEREOF

[75] Inventors: Yutaka Kumagawa; Masakazu Io, both of Nagasaki; Satoru Hara, Saga; Seiko Himeno, Fukuoka, all of Japan

[73] Assignee: Kabushiki Kaisha Discovery, Japan

[21] Appl. No.: 09/097,736

[22] Filed: Jun. 16, 1998

[51] Int. Cl.[7] ..... E01C 19/02

[52] U.S. Cl. ..... 404/82; 404/44

[58] Field of Search ..... 404/27, 31, 32, 404/33, 72, 82, 34, 44; 249/79, 83, 105, 661, 155; 264/133, 135, 319

[56] References Cited

U.S. PATENT DOCUMENTS

| | | | |
|---|---|---|---|
| 1,585,111 | 5/1926 | Reichert | 404/32 |
| 1,694,476 | 12/1928 | Lefebure | 404/32 |
| 3,801,421 | 4/1974 | Allen et al. | 404/32 |
| 4,457,120 | 7/1984 | Takata | 52/309.4 |
| 5,612,116 | 3/1997 | Jinno et al. | 428/143 |

*Primary Examiner*—Robert E. Pezzuto
*Assistant Examiner*—Kristine M. Markovich
*Attorney, Agent, or Firm*—Wenderoth, Lind & Ponack, L.L.P.

[57] ABSTRACT

A pavement composite material having elasticity and permeability can be obtained by accommodating a permeable concrete block after the solidification molding applied with an adhesive having a 50 to 100 centipoise viscosity on the surface to be bonded in a heat press mold, injecting a mixture of 50 to 90% by weight of rubber or plastic chips having a 1.0 to 10.0 mm particle size and 50 to 10% by weight of a thermosetting resin thereon, and a heat compression molding.

1 Claim, 1 Drawing Sheet

PAVEMENT COMPOSITE MATERIAL WITH ELASTIC SURFACE LAYER AND PRODUCTION METHOD THEREOF

BACKGROUND OF THE INVENTION

1. Field of the Invention

The present invention relates to a pavement composite material, more specifically to a pavement composite material having elasticity and permeability, effectively utilizing wastes of rubber or plastic, and production method thereof.

2. Description of the Related Art

As a known example of a pavement composite material having elasticity and permeability, one comprising an upper layer material produced by the compression molding of rubber or plastic chips as the aggregate and a thermosetting urethane resin as the binder, and a lower layer material made from a permeable concrete after the solidification molding, bonded with each other by an epoxy adhesive, can be presented.

However, since the upper layer material and the lower layer material are bonded after the solidification molding in the production of such a conventional pavement composite material, a problem is involved in that a sufficient adhesive force cannot be obtained between a rugged lower layer material surface to be bonded and the upper layer material, resulting in peel-off.

A method of applying an adhesive on the rugged surface of the lower layer material so as to improve the adhesive force by the fixing effect can be considered. However, due to the need of a large amount of the adhesive, an adhesive layer is formed between the upper layer material and the lower layer material, and thus a problem is involved in that the permeability is lost even though the adhesive force can be improved.

SUMMARY OF THE INVENTION

In order to solve the above-mentioned problems, an object of the present invention is to provide a pavement composite material having elasticity and permeability, where an upper layer having rubber or plastic chips as the aggregate and a lower layer material made from a permeable concrete are strongly bonded without losing the permeability, and a production method thereof.

A pavement composite material of the present invention comprises a lower layer material made from a permeable concrete, and an upper layer material comprising a mixture of 50 to 90% by weight of rubber or plastic chips having a 1.0 mm to 10.0 mm particle size and 50 to 10% by weight of a thermosetting resin, bonded via a thin adhesive layer having a 50 to 100 centipoise viscosity. A production method thereof comprises a step of contacting a permeable concrete block after the solidification molding applied with an adhesive having a 50 to 100 centipoise viscosity with a heat press mold, a step of injecting a mixture of 50 to 90% by weight of rubber or plastic chips having a 1.0 to 10.0 mm particle size and 50 to 10% by weight of a thermosetting resin thereon, and a step of a heat compression molding.

Since the rubber or plastic chips to be used as the aggregate for the upper layer material have a 1.0 to 10.0 mm particle size and the mixture ratio of the aggregate and the thermosetting resin is 50 to 90% by weight and 50 to 10% by weight respectively, an upper layer having both strength and permeability can be obtained.

Further, since the adhesive to be applied on the surface to be bonded of the lower layer material has a 50 to 100 centipoise viscosity and the upper layer material mixture is placed thereon for the heat compression molding, a thin adhesive layer having a sufficient adhesion strength and an appropriate permeable gap can be provided, and thus a pavement composite material comprising an elastic surface layer with a permeability and a good adhesion can be obtained.

DESCRIPTION OF THE PREFERRED EMBODIMENTS

Embodiments of the present invention will be explained with reference to the accompanied drawings.

Figure 1:
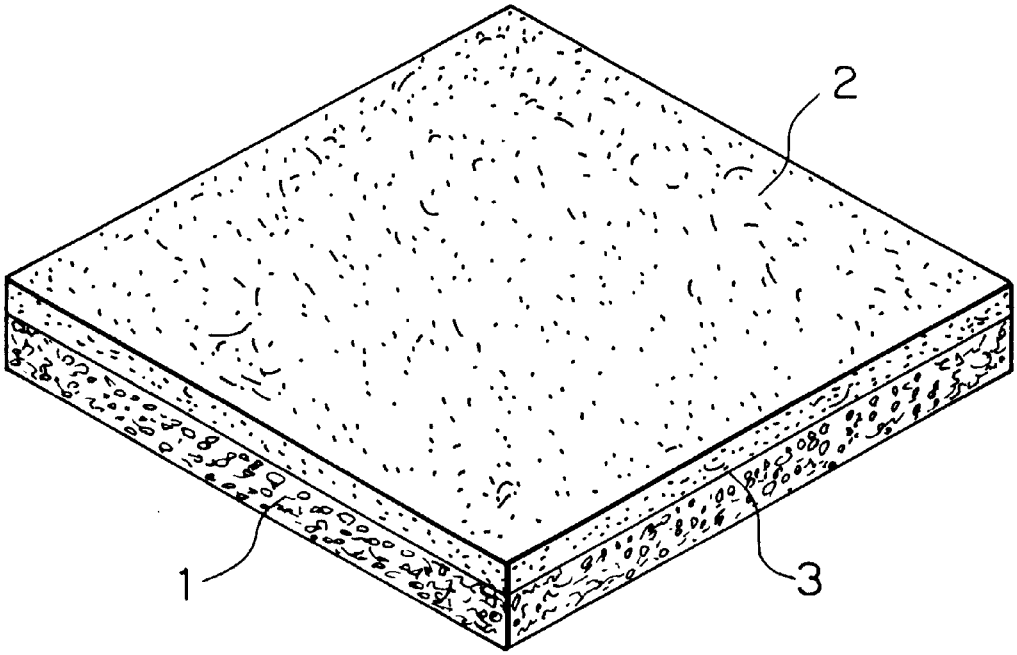
FIG. 1 is a perspective view showing a pavement composite material according to one embodiment of the present invention.

As shown in FIG. 1, a pavement composite material according to one embodiment of the present invention comprises an upper layer material 2 integrally bonded onto a lower layer material 1 made from a permeable concrete block with an adhesive 3. The upper layer material 2 comprises a mixture of 50 to 90% by weight of rubber or plastic chips having a 1.0 to 10.0 mm particle size and 50 to 10% by weight of a thermosetting resin. The adhesive 3 has a 50 to 100 centipoise viscosity. With the upper layer material 2 and the adhesive 3, an elastic surface layer is formed with sufficient elasticity and permeability on the lower layer material 1.

Figure 2:
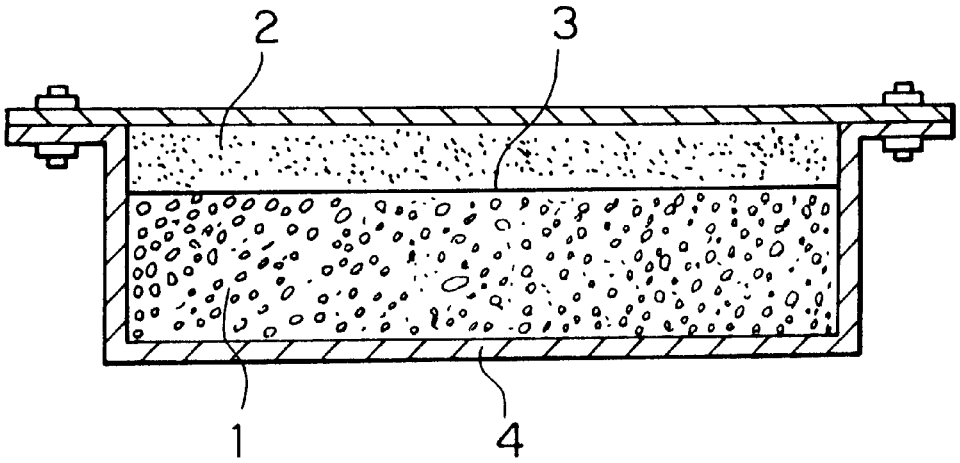
FIG. 2 is a cross-sectional view showing a production process of a pavement composite material of the present invention.

A production method of the pavement composite material will be explained. After applying the adhesive 3 having a 50 to 100 centipoise viscosity on the upper surface of the lower layer material 1 made from a permeable concrete block after the solidification molding with a roll coater, the concrete block is accommodated in a heat press mold 4 as shown in FIG. 2. A mixture of 50 to 90% by weight of rubber or plastic chips having a 1.0 to 10.0 mm particle size and 50 to 10% by weight of a thermosetting resin is injected on the adhesive 3 on the upper surface of the lower layer material 1 so as to be heat press-molded for bonding the upper layer material and the lower layer material integrally.

As mentioned above, since the rubber or plastic chips to be used as the aggregate for the upper layer material have a 1.0 to 10.0 mm particle size and the mixture ratio of the aggregate and the-thermosetting resin is 50 to 90% by weight and 50 to 10% by weight respectively, an upper layer having both strength and permeability can be obtained.

Further, since the adhesive to be applied on the surface to be bonded of the lower layer material has a 50 to 100 centipoise viscosity and the upper layer material mixture is placed thereon for the heat compression molding, a thin adhesive layer having a sufficient adhesion strength and an appropriate permeable gap can be provided. According to an experiment, with an adhesive with a less than 50 centipoise viscosity, it was learned that the adhesion force was deteriorated. On the other hand, with an adhesive with more than 100 centipoise viscosity, the adhesion force was improved, however, an adhesion layer was formed so as to lose the permeability.

Hereinafter a further specific example will be described. To the upper surface of a lower layer material 1 made from a permeable concrete block after the solidification molding using rubbles having a 5 to 10 mm particle size as the aggregate, 200 g/m$^2$ of an adhesive 3 having a 50 to 100 centipoise viscosity (such as the concrete impregnating adhesion applying material Bond E200P produced by Konishi Corp.) was applied with a roll coater. After drying for 60 minutes at an ordinary temperature, it was accommodated in a press mold 4.

A mixture of 50 to 90% by weight of rubber chips having a 1.0 to 10.0 mm particle size obtained by crushing waste tires and 50 to 10% by weight of a thermosetting resin (such as Bandex TT-1221 produced by Dainippon Ink Corp.) was injected thereon. After flattening the surface, a lid was put on and bolted. After applying a heat treatment for 10 minutes with a 110 to 150° C. furnace temperature, it was left at a room temperature for cooling. Then the mold was released.

Accordingly, a pavement composite material comprising an elastic surface layer having elasticity and permeability with a sufficient adhesion strength can be obtained utilizing a waste material such as rubber or plastic.

What is claimed is:

1. A method for producing a pavement composite material comprising:

a step of applying an adhesive having a 50 to 100 centipoise viscosity on a permeable concrete block after solidification molding, a step of accommodating the concrete block in a heat press mold, a step of injecting a mixture of 50 to 90% by weight of rubber or plastic chips having a 1.0 to 10.0 mm particle size and 50 to 10% by weight of a thermosetting resin on the upper surface of the concrete block applied with the adhesive, and a step of a heat compression molding after clamping the heat press mold.

* * * * *